US005694641A

United States Patent [19]

Doi et al.

[11] Patent Number: 5,694,641

[45] Date of Patent: Dec. 9, 1997

[54] FLEXING BASEBALL GLOVE

[75] Inventors: Masao Doi; Kazunori Satoh, both of Osaka, Japan

[73] Assignee: Zett Kabushiki Kaisha, Osaka-Fu, Japan

[21] Appl. No.: 641,587

[22] Filed: May 1, 1996

[30] Foreign Application Priority Data

Sep. 14, 1995 [JP] Japan ..... 7-236371

[51] Int. Cl.[6] ..... A41D 13/08

[52] U.S. Cl. ..... 2/19; 2/161.1

[58] Field of Search ..... 2/16, 18, 19, 20, 2/159, 161.1, 161.6, 161.5, 169, 163; D29/115

[56] References Cited

U.S. PATENT DOCUMENTS

| | | | |
|---|---|---|---|
| 967,120 | 8/1910 | Gamble | 2/19 |
| 2,746,050 | 5/1956 | Goldsmith | 2/19 |
| 3,076,971 | 2/1963 | Steiman | 2/19 |
| 3,300,787 | 1/1967 | Denkert | 2/19 |
| 5,448,775 | 9/1995 | Yamada et al. | 2/19 |

*Primary Examiner*—C. D. Crowder
*Assistant Examiner*—Larry D. Worrell, Jr.
*Attorney, Agent, or Firm*—Townsend and Townsend and Crew LLP

[57] ABSTRACT

A ball catching apparatus such as a baseball glove is disclosed. The apparatus includes a palm-side shell provided on a ball-catching side of the apparatus, a back-side shell provided on a non-ball-catching side of the apparatus, and an extension portion provided at a little-finger base portion of the palm-side shell and connected with the back-side shell. A flexing portion is provided for flexing the extension portion toward the non-ball-catching side of the apparatus.

11 Claims, 4 Drawing Sheets

FLEXING BASEBALL GLOVE

BACKGROUND OF THE INVENTION

1. Field of the Invention

The present invention relates to a ball catching apparatus having a palm-side shell on the ball-catching side and a back-side shell on the opposite, non-ball-catching side.

2. Description of the Related Art

For catching a ball with a ball catching apparatus noted above, the user flexes inwards the little-finger section of the apparatus relative to the thumb section. As shown in FIG. 5, the apparatus includes a ball-catching palm-side shell 1 and a non-ball-catching back-side shell 2. In particular, a little-finger base portion 3 of this apparatus has a cross sectional construction as shown in FIG. 6. That is, as denoted with a mark C in FIG. 6, this portion has a triple-layer construction consisting of an outer layer 1*a* and an inner layer 1*b* of the palm-side shell 1 and the further layer of the back-side shell 2, which construction makes difficult the above-described ball catching action by flexing the little-finger section.

For solving the above problem, the prior art has suggested an improved construction as disclosed in the Japanese examined utility model gazette No. 38-2818. In this improved construction, as shown in FIG. 7, a cutout 20 is provided in the little-finger base portion 3 so as to improve the flexibility of the little-finger section of the apparatus thereby to enable a reliable ball catching action.

However, there remains a problem with this improved construction as described next.

Namely, with the construction of FIG. 7 providing the cutout 20, the position at which the little-finger section is flexed relative to the remaining portion of the apparatus is fixedly determined, so that the user cannot readily change the flexing position depending on his/her preference or convenience.

SUMMARY OF THE INVENTION

In view of the above-described state of the art, a primary object of the present invention is to solve the problems of the prior art by providing a ball catching apparatus providing further improved flexibility of the little-finger section by allowing the flexing position to be varied depending on the user's preference or convenience.

It is a further object of the present invention to provide a ball catching apparatus which allows a more reliable ball catching action than the conventional apparatuses.

For accomplishing the above objects, a ball catching apparatus, according to the present invention, comprises:

- a palm-side shell provided on a ball-catching side of the apparatus;
- a back-side shell provided on a non-ball-catching side of the apparatus;
- an extension portion provided at a little-finger base portion of the palm-side shell and connected with the back-side shell; and
- a flexing portion for flexing the extension portion toward the non-ball-catching side.

The above construction includes an extension portion provided at the little-finger base portion and a flexing portion for flexing the extension portion toward the non-ball-catching side, so that the palm-side shell and the extension portion may together be formed of a single sheet of shell, e.g. leather.

As a result, the flexibility of the little-finger section of the apparatus is improved and also the reliability of the ball catching action is improved also.

According to a further aspect of the invention, the flexing portion includes a first cutout.

By providing this cutout, the flexibility of the little-finger section may be further improved.

According to a still further aspect of the invention, the first cutout includes a plurality of slits.

In this case, a desired one of these slits may be flexed.

As a result, the user may change the position of flexion, depending on his/her preference or convenience.

According to a still further aspect of the invention, the apparatus further comprises a second cutout provided at a portion other than the flexing portion of the little-finger base portion.

With the second cutout in combination with the flexing portion, the flexibility of the little-finger section may be further improved.

According to a still further aspect of the invention, the back-side shell includes a belt portion for forming a hand inserting opening, the belt portion being connected with the extension portion.

The extension portion is provided at the little-finger base portion of the palm-side shell. Then, by connecting this extension portion with the belt portion, the entire baseball catching apparatus having the above-described essential features may be constructed simple.

Preferably, the flexing portion of the extension portion has a length shorter than a length of the portion of the extension portion to be connected with the belt portion.

The belt portion is provided for protecting the back of the user's hand and requires a certain minimum width for this purpose. On the other hand, the shorter the flexing portion, the better the flexibility at the little-finger section.

Accordingly, with the above-described setting of the lengths of the respective portions of the extension portion, both of the functions required respectively of the belt portion and the flexing portion may be provided without deterioration.

Preferably, the palm-side shell includes an outer layer and an inner layer, and the first cutout is provided in both of these inner and outer layers.

This construction facilitates the flexion of both the outer layer and inner layer.

As a result, the flexibility of the little-finger section may be further improved.

Preferably, the little-finger base portion of the palm-side shell and an outer layer of the little-finger base portion of the back-side shell are connected to each other via a single sheet of leather.

That is, the little-finger section to be flexed for a ball catching action is connected via a single sheet of leather member. As a result, the flexibility at the little-finger section of the apparatus may be further improved.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of the present invention will be particularly described next with reference to the accompanying drawings.

Figure 1:
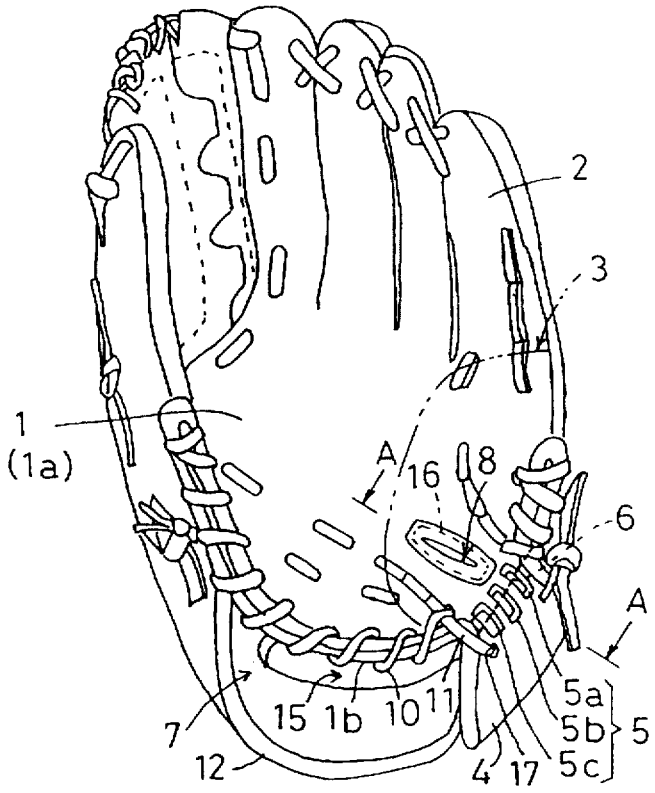
FIG. 1 shows an appearance of a ball-catching side of a baseball glove relating to the present invention.

FIG. 1 shows a baseball glove, as one example of ball-catching apparatus of the invention, as viewed from a ball-catching side thereof. FIG. 3 shows the same baseball glove as viewed from the opposite side, i.e. non-ball-catching side thereof. In FIG. 1, a palm-side shell 1 constitutes the portion for use in catching a ball. This palm-side shell 1 includes an outer layer 1*a* and an inner layer 1*b* and these outer an inner layers *a*, 1*b* are joined to each other by means of a lace 10. A little-finger base portion 3 of a little-finger section 2 for allowing insertion of a little finger is denoted by an alternate long and two short dash line. And, at this little-finger base portion 3, an extension portion 4 is provided. This extension portion 4 is formed integrally with and of the same shell as the palm-side shell 1 and is flexed at a flexing portion 6. The flexing portion 6 is denoted by a dotted line in FIGS. 1 and 2. A hand inserting opening 7 is provided for allowing insertion of a user's hand into the glove. A first cutout 5 is formed in the flexing portion 6 and a second cutout 8 is formed in the little-finger base portion 3.

Referring to FIG. 3, a back-side shell 9 includes a laterally elongate hole 15 and a belt portion 12. And, the belt portion 12 and the palm-side shell 1 together form the hand inserting opening 7. Further, a leading end 12*a* of the belt portion 12 and a leading end 4*a* of the flexed extension portion 4 are connected to each other by means of laces 13, 14. The belt portion 12 defines paired holes 12*b* at a plurality of positions, so as to allow adjustment of the connecting position between the belt portion 12 and the extension portion 4.

Figure 2:
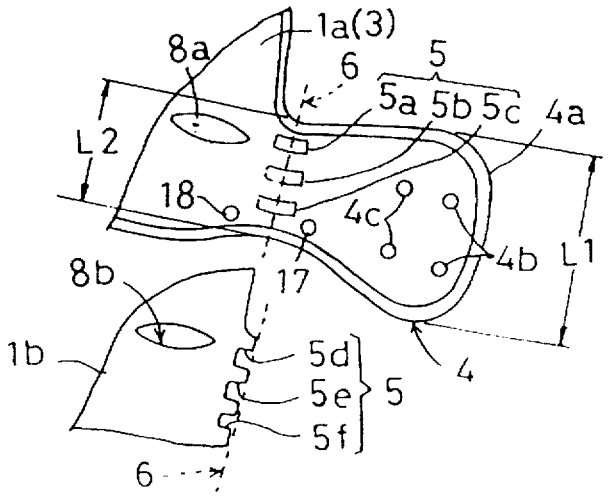
FIG. 2 is a development of an outer layer and an inner layer.
Figure 3:
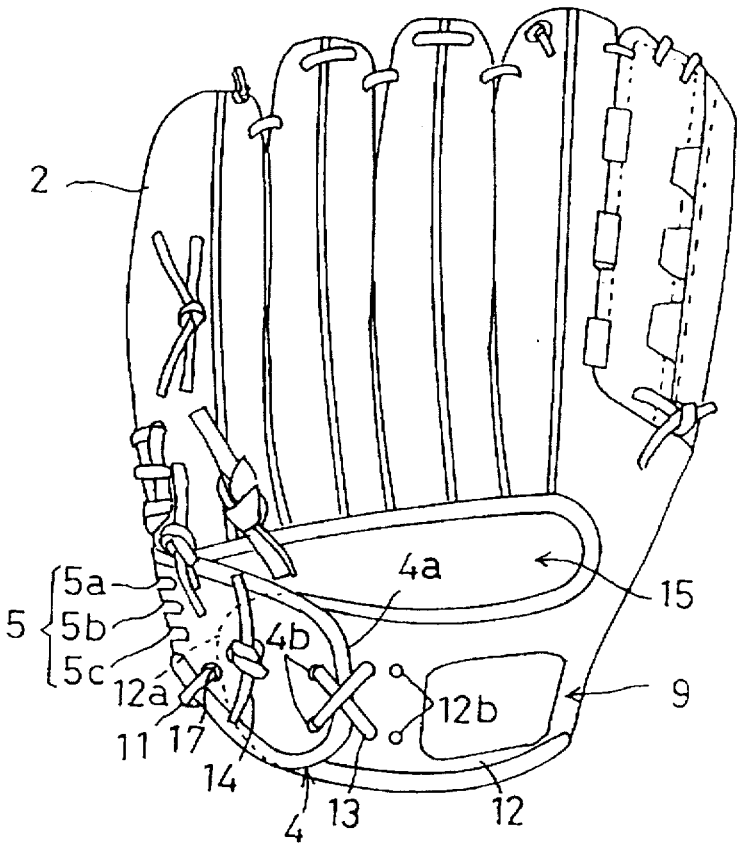
FIG. 3 shows an appearance of a non-ball-catching side of the baseball glove.

FIG. 2 shows in details the outer layer 1*a* and the inner layer 1*b* of the palm-side shell 1 in developed states thereof for better understanding. As shown in FIGS. 1 and 2, the first cutout 5 includes three slits 5*a*, 5*b*, 5*c*. The shape of these slits 5*a*, 5*b*, 5*c* is shown as rectangular. This shape is not limited thereto, however, but may be any other shape such as circular or oval shape. Further, these slits 5*a*, 5*b*, 5*c* preferably extend in a direction substantially normal to the direction along which the user's little finger is inserted. This arrangement may further improve the flexibility at the little-finger section. Also, while only one slit may be provided, it is preferred that plural of them be provided at a plurality of positions so that the little-finger section of the glove may be flexed using a desired slit as the pivot of flexion to suit the user's preference. Further, the flexing portion 6 is disposed along the common centerline of the slits 5*a*, 5*b*, 5*c*.

The inner layer 1*b* too defines a plurality of slits 5*d*, 5*e*, 5*g* like those defined in the outer layer 1*a*. But, the inner layer 1*b* is devoid of the extension 4 and presents a configuration as if this layer 1*b* is cut off at the flexing portion 6 of the outer layer 1*a*. When these outer and inner layers 1*a*, 1*b* are assembled to each other, the slits 5 defined in the respective layers are registered in position to each other; that is, the slits 5*a*, 5*d*, slits 5*b*, 5*e* and slits 5*c*, 5*f* are respectively registered in pairs with each other. Although these slits of the outer and inner layers 1*a*, 1*b* need not be registered with each other, the registered arrangement may further improve the flexibility of the little-finger section.

Further, in addition to the first cutout 5, a second cutout 8 may be provided. And, this second cutout 8 may be provided at any portion other than the flexing portion 6 of the little-finger base portion 3. For example, in the construction shown in FIGS. 1 and 2, this second cutout 8 is provided in the vicinity of the slits 5*a*, 5*b*. The second cutout 8 includes a substantially rectangular hole 8*a* defined in the outer layer 1*a* and a substantially rectangular hole 8*b* defined in the inner layer 1*b*. Also, these rectangular holes 8*a*, 8*b* longitudinally extends in a direction substantially normal to the longitudinal extending direction of the little-finger section 2. Then, when the outer and inner layers 1*a*, 1*b* are assembled, these holes 8*a*, 8*b* of the outer and inner layers 1*a*, 1*b* too are registered in position with each other. Incidentally, the periphery of the second cutout 8 is sewn by means of a thread 16.

The leading end 4*a* of the extension portion 4 has a length L1 which is longer than a length L2 of the flexing portion 6. Further, it is preferred that the length L1 of the leading end 4*a* is set to be substantially equal to the width of the belt portion 12. It is also preferred that the length L2 of the flexing portion 6 be set at the minimum needed for not impairing the strength of this flexing portion 6.

The extension portion 4 defines a pair of holes 4*b*, 4*c* for allowing introduction of laces 13, 14 for connecting this extension portion 4 with the belt portion 12.

Further, adjacent the slit 5*c* closest, of all the slits, 5*a*, 5*b*, 5*c*, to the hand inserting opening 7, there are provided a hole 17 defined in the extension portion 4 and a hole 18 defined in the little-finger base portion 3. Into these holes 17, 18, a lace 11 is introduced so as to keep the shape of flexing portion 6.

Figure 4:
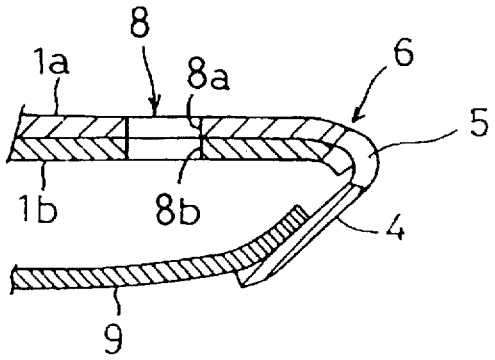
FIG. 4 is a section view taken along a line A—A in FIG. 1.
Figure 5:
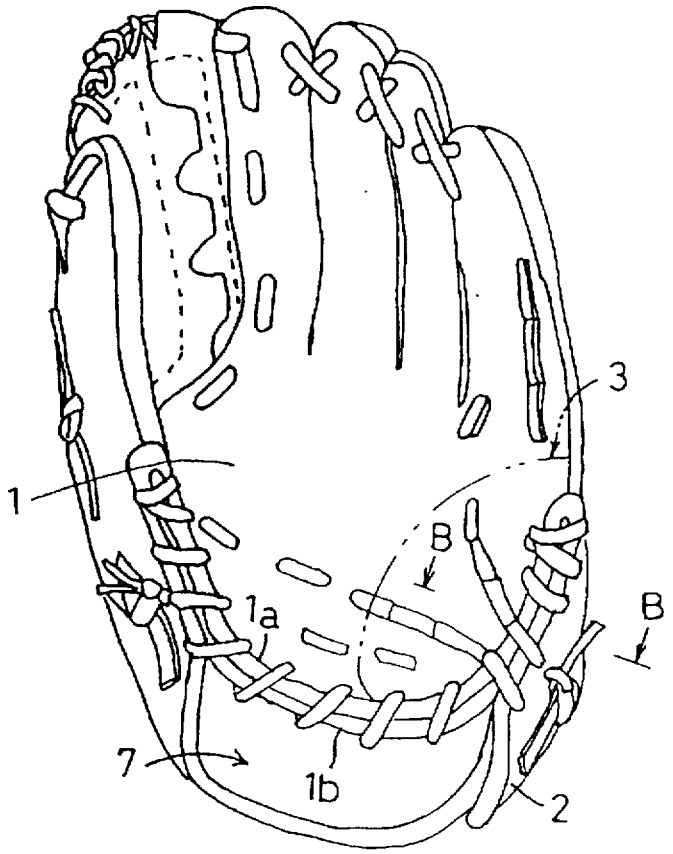
FIG. 5 (Prior Art)
FIG. 5 shows an appearance of a conventional baseball glove.
Figure 6:
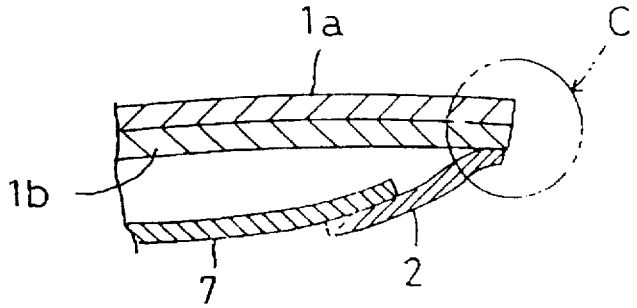
FIG. 6 (Prior Art)
FIG. 6 is a section view taken along a line B—B in FIG. 5.
Figure 7:
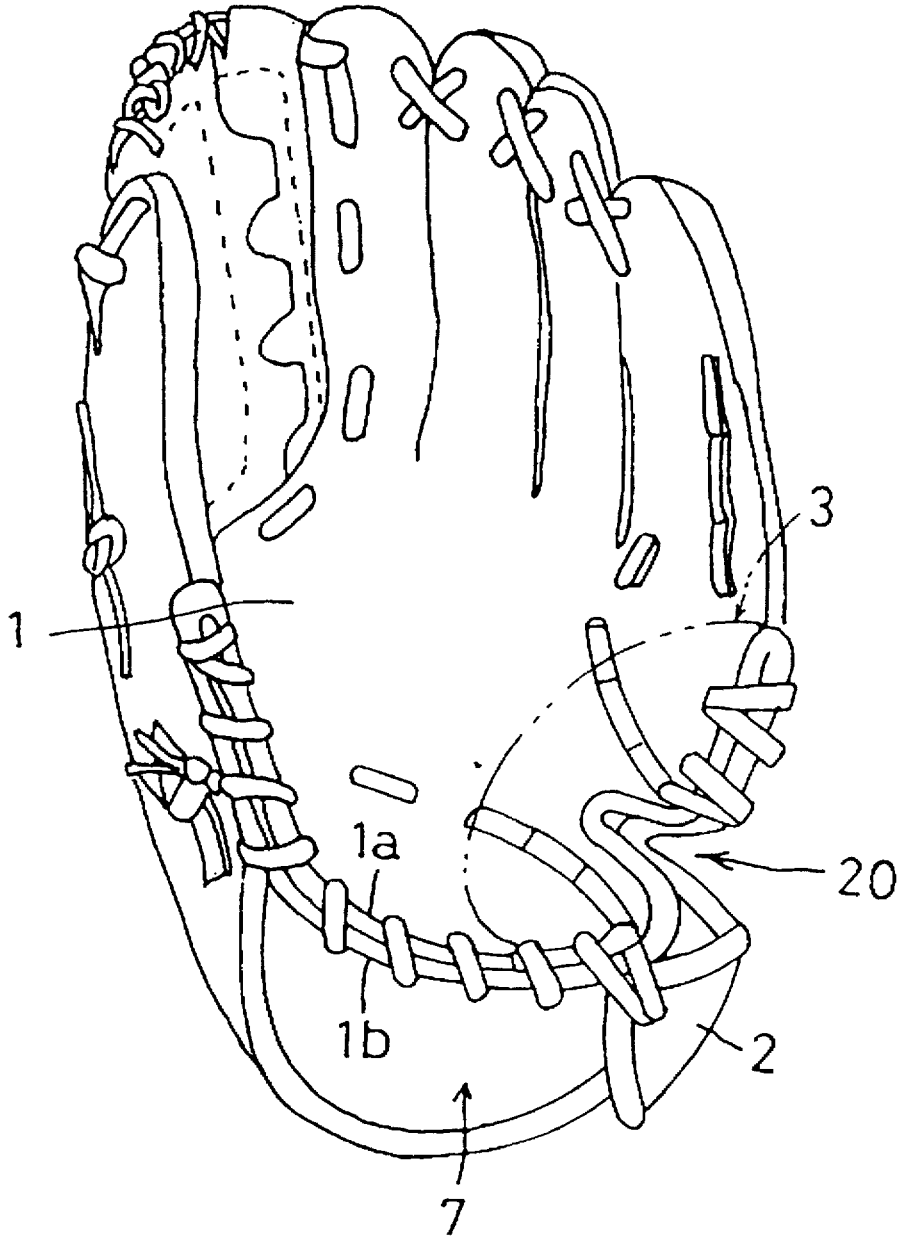
FIG. 7 (Prior Art)
FIG. 7 shows an appearance of another conventional baseball glove.

FIG. 4 is a section taken along a line A—A in FIG. 1. Comparison between the construction shown in this FIG. 4 and the conventional construction shown in FIG. 6 will clearly demonstrate the superiority of the construction of the present invention. That is, in the case of the construction of FIG. 6, the portion thereof corresponding to the flexing portion 6 has the triple-layer construction providing poor flexibility at the little-finger section. Whereas, in the case of the construction of FIG. 4, the palm-side shell 1 and the extension portion 4 are formed of a single layer of leather, thereby to provide much improved flexibility at the little-finger section.

other embodiments

Other embodiments of the present invention will be described next.

(1) The foregoing embodiment discloses a baseball glove. But, the present invention may be embodied as a baseball mitt or any other kind of ball catching apparatus as well.

(2) In place of the single second cutout 8, plural of them may be provided at a plurality of appropriate positions.

(3) In place of the first cutout 5 in the form of a two-dimensional slot, this first cutout 5 may be provided as a one-dimensional slit or linear cut.

(4) In the foregoing embodiment, the extension portion 4 is formed integral with the little-finger section 3 of the palm-side shell 1. Instead, this extension portion 4 may be formed integral with the little-finger section of the back-side shell 2. That, the essential requirement in the present invention is that the outer layer of the transition portion (flexion portion 6) between the palm-side shell 1 and the back-side shell 2 be formed of a single layer.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A baseball glove comprising:

a palm-side shell provided on a ball-catching side of the glove, the palm-side shell including an outer layer and an inner layer;

a back-side shell provided on a non-ball-catching side of the glove;

a little finger base portion provided at a base of a portion of the glove into which a user's little finger is to be inserted; and an integral extension portion formed by an integral extension of a little finger base portion of the outer layer of the palm-side shell from the ball-catching side to the non-ball-catching side of the glove, the extension portion being connected with said back-side shell on the non-ball-catching side of the glove when said extension portion is wrapped around from the ball-catching side in a direction toward the non-ball-catching side at a flexing portion.

2. A baseball glove as defined in claim 1, wherein said flexing portion includes a first slit.

3. A baseball glove as defined in claim 2, wherein said first slit comprises a plurality of slits.

4. A baseball glove as defined in claim 3, wherein each of the slits is a rectangular hole.

5. A baseball glove as defined in claim 3, wherein said slits extend in a direction substantially normal to a direction along which a user's little finger is inserted into the glove.

6. A baseball glove as defined in claim 2, wherein a second slit is formed in a portion of said little-finger base portion of said outer layer excluding said flexing portion.

7. A baseball glove as defined in claim 1, wherein said back-side shell includes a belt portion for forming a hand inserting opening, the belt portion being connected with said extension portion.

8. A baseball glove as defined in claim 7, wherein said flexing portion of the extension portion has a length shorter than a length of the portion of the extension portion to be connected with the belt portion.

9. A baseball glove as defined in claim 2, wherein said first slit is provided in both of said inner layer and said outer layer.

10. A baseball glove as defined in claim 9, wherein said first slit in said outer layer and said first slit in said inner layer are registered in position with each other when the inner and outer layers are assembled to each other.

11. A baseball glove comprising:

a palm-side shell provided on a ball-catching side of the glove, the palm-side shell including an outer layer and an inner layer;

a back-side shell provided on a non-ball-catching side of the glove;

a little finger base portion on the palm-side shell defined by a base of a portion of the glove into which a user's little finger is to be inserted; and an integral extension portion integrally extending from the outer layer of the palm-side shell at the little finger base portion wherein said integral extension portion wraps around from the ball-catching side to the non-ball-catching side of the glove to connect with the back-side shell on the non-ball-catching side of the glove, said integral extension including a flexing portion having a plurality of slits along a direction which the user's little finger is to be inserted, wherein said slits are oriented in a direction perpendicular to the user's little finger to improve flexibility toward the ball-catching side of the glove.

* * * * *